US006314729B1

(12) United States Patent
Crull et al.

(10) Patent No.: US 6,314,729 B1
(45) Date of Patent: Nov. 13, 2001

(54) HYDRAULIC FAN DRIVE SYSTEM HAVING A NON-DEDICATED FLOW SOURCE

(75) Inventors: Stanley W. Crull, Ames; Mark A. Peterson, Gilbert, both of IA (US)

(73) Assignee: Sauer-Danfoss Inc., Ames, IA (US)

( * ) Notice: Subject to any disclaimer, the term of this patent is extended or adjusted under 35 U.S.C. 154(b) by 0 days.

(21) Appl. No.: 09/508,587

(22) PCT Filed: Jul. 21, 1999

(86) PCT No.: PCT/US99/16506

§ 371 Date: Mar. 14, 2000

§ 102(e) Date: Mar. 14, 2000

(87) PCT Pub. No.: WO00/05490

PCT Pub. Date: Feb. 3, 2000

Related U.S. Application Data

(60) Provisional application No. 60/093,917, filed on Jul. 23, 1998.

(51) Int. Cl.[7] ..... F16D 31/02

(52) U.S. Cl. ..... 60/456; 60/452

(58) Field of Search ..... 60/452, 456, 489, 60/329; 417/46

(56) References Cited

U.S. PATENT DOCUMENTS

| | | | |
|---|---|---|---|
| 3,659,567 | 5/1972 | Murray | 123/41.12 |
| 4,179,888 | 12/1979 | Goscenski, Jr. | 60/420 |
| 4,200,146 | 4/1980 | Olson | 165/39 |
| 4,223,646 | 9/1980 | Kinder | 123/41 |
| 4,446,697 | 5/1984 | Goscenski, Jr. | 60/443 |
| 4,470,259 | 9/1984 | Miller et al. | 60/422 |
| 4,470,260 | 9/1984 | Miller et al. | 60/422 |
| 4,738,330 | 4/1988 | Suzuki et al. | 180/141 |
| 5,666,807 * | 9/1997 | Bianchetta | 60/329 |

FOREIGN PATENT DOCUMENTS

4238998-A1 * 5/1994 (DE) .

* cited by examiner

*Primary Examiner*—Edward K. Look
*Assistant Examiner*—Thomas E. Lazo
(74) *Attorney, Agent, or Firm*—Zarley, McKee, Thomte, Voorhees & Sease

(57) ABSTRACT

A specific type of hydraulic fan drive system is provided for engine drive machines, such as on road and off road machines, such as buses, construction equipment, agricultural equipment, and so on. The hydraulic fan drive systems turn a cooling fan (39) which provides airflow to cool the engine on such machines. This system uses a proportional pressure reducing valve (34) (or combination of valves providing a pressure reducing function) between the pump (12) and the fan motor (38). This valve (34) or (combination of valves) controls the pressure drop across the fan motor (38) based on a control signal from an electronic controller (50). The valve allows as little or as much flow to pass as is required to maintain this pressure drop at the load (the fan motor (38)).

4 Claims, 1 Drawing Sheet

HYDRAULIC FAN DRIVE SYSTEM HAVING A NON-DEDICATED FLOW SOURCE

This appln is a 371 of PCT/US99/16506 filed Jul. 21, 1999 and claims benefit of PROVISIONAL APPLICATION SER. NO. 60/093,917 FILED JUL. 23, 1998.

BACKGROUND OF THE INVENTION

Hydraulic fan drive systems for buses and the like have traditionally required a dedicated flow source to allow sufficiently accurate control of fan speed. This requires either a dedicated fan drive pump, or a dedicated flow amount from a priority flow source from a pump. It is desirable, however, in some applications, to use only a portion of the total flow from an existing hydraulic pump, and share the total pump flow with other work functions on the machine.

It is therefore a principal object of this invention to provide a speed modulating hydraulic fan drive system which shares flow from one source with other work functions.

A further object of this invention is to provide a speed modulating hydraulic fan drive system which will reduce the number of pumps required for the total work system.

A still further object of this invention is to provide a speed modulating hydraulic fan drive system which utilizes a pressure reducing valve which will allow only enough fluid to pass to develop the desired fan motor pressure drop.

A still further object of this invention is to provide a speed modulating hydraulic fan drive system which makes use of an electronic controller to command the pressure level of the pressure reducing valve, and which can respond directly to a communication signal of the electronic controller of the engine of the vehicle.

These and other objects will be apparent to those skilled in the art.

SUMMARY OF THE INVENTION

A specific type of hydraulic fan drive system is provided for engine driven machines, such as on road and off road machines, such as buses, construction equipment, agricultural equipment, and so on. The hydraulic fan drive systems turn a cooling fan which provides airflow to cool the engine on such machines. This system uses a proportional pressure reducing valve (or combination of valves providing a pressure reducing function) between the pump and the fan motor. This valve or (combination of valves) controls the pressure drop across the fan motor based on a control signal from an electronic controller. The valve allows as little or as much flow to pass as is required to maintain this pressure drop at the load (the fan motor).

DESCRIPTION OF THE PREFERRED EMBODIMENT

Figure 1:
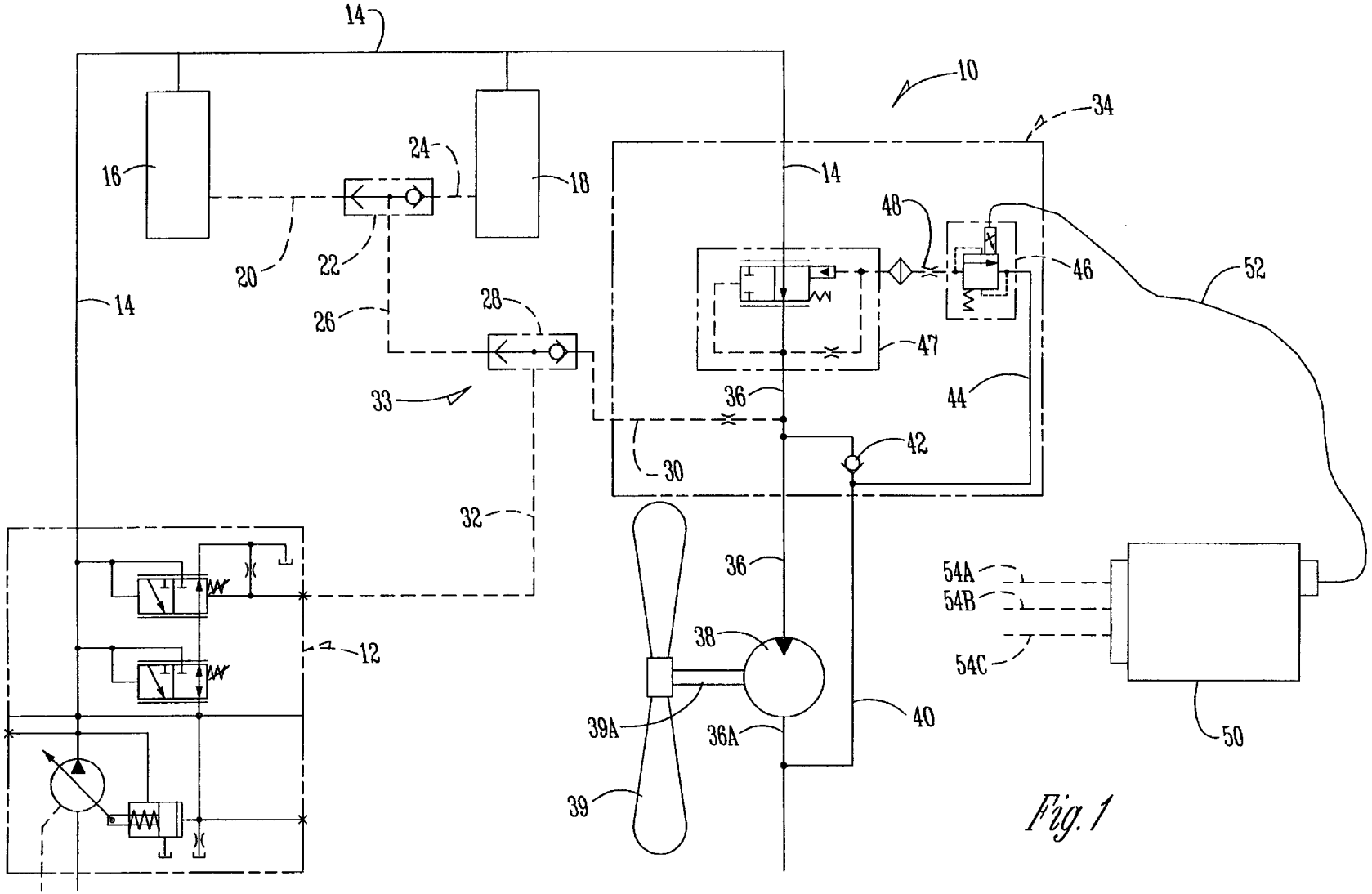
FIG. 1 is a schematic drawing of the circuitry of this invention.

As previously indicated, this invention relates to hydraulic fan systems for a plurality of on and off the road engine driven machines. The hydraulic fan drive systems turn a cooling fan which provides airflow to cool the engine on such machines. This system uses a proportional pressure reducing valve (or combination of valves providing a pressure reducing function) between the pump and the fan motor. This valve or (combination of valves) controls the pressure drop across the fan motor based on a control signal from an electronic controller. The valve allows as little or as much flow to pass as is required to maintain this pressure drop at the load (the fan motor).

The purpose of the controller is to produce the desired radiator fan speed (and therefore cooling air flow) for a given engine operating condition. Since fan speed is proportional to the square of the pressure drop across the hydraulic fan motor, a specific motor pressure drop results in a specific fan speed. The controller generates the control signal to this valve based on various temperature levels measured at the engine, such as engine coolant temperature, charge air temperature, lubricating oil temperature, and/or other engine temperatures which may dictate a need for cooling air flow. The signal from the controller may also be modified based on different engine or machine operating modes, such as a mode which would call for a "full fan speed" condition or a "minimum fan speed" condition. Alternatively the controller may respond directly to a communication signal coming from the engine's own electronics, to determine the desired cooling flow and therefore the output signal to the valve.

The system can work with a variable output, load sensing hydraulic circuit as follows: a load sensing line is tapped into the flow passage between the pressure reducing valve outlet and the fan motor inlet. This signal ensures that the pressure at the inlet of the pressure reducing valve is always a sufficient level higher than the outlet pressure demanded from that valve. The same load sensing circuit provides hydraulic flow to several machine functions other than the fan drive. If one of these functions requires more pressure than the fan drive, then the total system pressure rises to the need of this other work function, and the pressure reducing valve for the fan drive simply restricts flow to reduce its outlet pressure to the commanded level. In certain applications, a priority pressure valve can be used between critical work functions (steering and brakes) and the non-critical functions (fan and other), to ensure that the critical functions always have sufficient pressure to perform their functions. Even with this priority pressure valve, the fan drive system will function properly until the point where the load sensing circuit is at its maximum possible flow level.

This invention provides for a speed modulating hydraulic fan drive system to share flow from one flow source with other work functions without requiring a dedicated flow source for the fan drive. It also provides for a speed modulating hydraulic fan drive system to be included on a machine without requiring an additional pump to be designed into the system (when compared to a similar system without a hydraulic fan drive), since the fan drive system can share total flow available with other work functions. This is an advantage because the machine requires one less hydraulic pump (when compared to a conventional hydraulic fan drive system), and therefore one less location for mounting a pump. A pump which shares some of its total flow with the fan drive system would simply have to be some amount larger than an otherwise similar system where a hydraulic fan drive is not used.

The invention can also be used with a fixed flow source (such as a fixed displacement pump or fixed priority flow) type system, or a variable flow pump with a pressure compensator type pump control, as long as the relief or compensating pressure level is higher than the highest fan drive pressure requirement at any time. The pressure reducing valve will allow only enough fluid to pass to develop the desired fan motor pressure drop, and therefore the desired fan cooling airflow. With a fixed flow system, the excess flow will then pass over the system relief valve. With a pressure-compensated-only system, the pump will develop the flow demanded by the pressure reducing valve, and the pressure at the inlet of the pressure reducing valve will always be maintained at the pump's pressure compensator setting.

The invention makes use of an electronic controller to command the pressure reducing valve's pressure level. This controller can respond to one or more temperature inputs, and can base the output signal to the valve on whichever temperature indicates the highest need for cooling, at any given time. As indicated above, typical temperatures monitored by the controller may include, but are not limited to, the following: engine coolant temperature, engine oil temperature, mechanical transmission fluid temperature, hydraulic fluid temperature, or charge air temperature.

The electronic controller used in this invention can also modify its output signal to the valve based on certain temperatures exceeding a predetermined level. These temperatures can be sensed with one or more temperature switches, connected to the controller's switch input(s). The controller can be programmed to respond to these inputs, individually, by putting the fan drive system to full fan speed, minimum fan speed, or some intermediate fan speed, as required by the condition which triggered the temperature switch.

The electronic controller used in this invention can also modify its output signal to the valve based on the individual requirements of different engine or machine operating modes. The alternative mode(s) would be signaled to the controller by external electrical switches connected to the controller's switch inputs. The controller can be programmed to respond to these modes, individually, by putting the fan drive system to full fan speed, minimum fan speed, or some intermediate fan speed, as required by the engine or machine mode in question. For example, in a vehicle application, a signal from an auxiliary function (e.g., extending a large cylinder) signals the controller to reduce fan speed momentarily to minimum, to provide maximum available flow to the cylinder. Alternatively, the electronic controller can respond directly to a communication signal coming from the engine's own electronics, to determine the desired cooling flow and therefore the output signal to the valve.

With reference to FIG. 1, the numeral 10 designates a vehicle hydraulic system and controls. This system includes pump 12 which is a conventional pressure compensating load sensing variable displacement fluid pump. It has an outwardly extending pressurized fluid output line 14 and is connected to first and second adjunct power circuits 16 and 18. These two circuits could represent the brake circuit for the vehicle and the steering circuit for the vehicle, for example. A load sensing signal line 20 extends from circuit 16 and is operatively connected to selector shuttle 22. Similarly, signal line 24 extends from circuit 18 and also extends to the selector shuttle 22. The selector shuttle has the capability of selecting between the stronger incoming signals on lines 20 and 24, and causing the stronger signal to exit the shuttle via signal line 26.

Load sensing signal line 26 extends to selector shuttle 28 which also receives signal line 30 which will be discussed hereafter. Selector shuttle 28 has the capability of selecting the stronger incoming signal on lines 26 and 30, and transmitting the same outwardly via signal line 32 for connection with the pump 12. The numeral 33 in FIG. 1 collectively refers to a load sensing circuit comprised of the circuits 16, 18 and perhaps others, including shuttles 22 and 28, and the various signal lines associated therewith.

A conventional variable pressure reducing valve 34 is imposed in pressurized fluid output line 14 downstream of circuits 16 and 18. The valve 34 has the capability of receiving an output signal, and thereupon reducing the pressure, and hence the flow through line 14. The numeral 36 designates the fluid output line from valve 34.

It should be noted that the previously described signal line 30 interconnects line 36 with shuttle 28 so as to continuously transmit to shuttle 28 the hydraulic load within line 36.

Line 36 then extends to the hydraulic fan motor 38 which has a conventional fan blade 39 suspended on an outwardly extending fan shaft 39A. Motor 38 has an output line 36A which extends to a fluid reservoir (not shown) for pump 12.

A fluid anti-cavitation line 40 is connected by its ends to lines 36 and 36A on opposite sides of motor 38 so as to be in parallel with lines 36 and 36A. A check valve 42 is imposed in line 40 so as to ordinarily prevent fluid flow to move in line 40 towards line 36A. The purpose of line 40 is to safeguard the motor 38 against cavitation wherein a normal supply of fluid is being withheld from the motor. In that case, the rotational speed of the blade 39 will decrease, and the motor 38 will momentarily be converted to a pump with respect to the fluid therein, and the fluid in the motor will be "pumped" outwardly towards the reservoir through line 36A. However, some of the fluid so pumped from motor 38 will return through line 40 and will lift check valve 42 wherein the fluid will move back into line 36 to be returned to the motor. Thus, the supply of fluid in the motor will not be exhausted, and the motor will not cavitate.

A fluid drain line 44 is connected to line 40 downstream of normally closed check valve 42 and extends from proportional relief valve 46 which forms a part of variable pressure reduction valve 34. The function of conventional valve 46 is to receive incoming signals and convert the same so as to actuate pressure reducing valve component 47 to reduce the fluid flow in line 14 commensurate with the incoming signal. The hydraulic signal connection between proportional relief valve 46 and pressure reducing valve component 47 is designated by the numeral 48.

A digital fan drive controller 50 is located proximate to the system 10 and has a signal cable 52 extending therefrom to the proportional relief valve 46. The controller 50 has a plurality of temperature input signal lines 54A, 54B, and 54C which can be connected to any one of a number of operational fluid bodies in the system, such as radiator coolant fluid; motor oil; transmission oil, etc. The controller 50 continuously receives input signals through the lines 54A–54C, (and other lines if desired) to continuously monitor these bodies of fluid. The controller is normally programmed to control the speed of rotation of the fan motor 38 to maintain predetermined temperature conditions in each body of fluid.

The circuits 16 and 18 typically will have their own flow valve (not shown) operated by a brake pedal, or a steering wheel, for example, so that the flow valve in the circuit will be opened when a surge of hydraulic flow is needed so as to receive the additional fluid flow supplied by the pump 12 which is actuated by the functioning of the selector shuttles as described above.

From the foregoing, it is seen that the load sensing circuit 33 including selector shuttles 22 and 28 will sort through the load sensing signals from lines 20, 24, 26 and 30 to deliver the highest load sensing signal back to pump 12 for response to the greatest pressure need. Again, this is a continuing process which enables the system to respond to special component needs as they arise, and which seeks to balance the hydraulic needs of the components.

It is therefore seen that this invention will accomplish at least all of its stated objectives.

What is claimed is:

1. A hydraulic fan drive system, comprising, a fan coupled to a fan hydraulic motor, a single hydraulic purnp connected to the fan hydraulic motor and having a pressure outlet flow capability greater than the fluid flow required to operate the fan motor at the normal operating speed, a pressure reduction valve connected to a pressure flow outlet line of the pump upstream of the fan hydraulic motor, an electronic controller operatively connected to the pressure reduction valve to control the fluid pressure therethrough, a plurality of temperature sensitive bodies associated with the system, a signal emitting sensor associated with at least some of the bodies and connected to the controller to transmit an electronic signal to the controller relative to the temperature of the body from which it extends, whereby the controller can adjust the fluid pressure to the fan motor through the pressure reduction valve to increase or decrease the speed of the fan to accommodate the temperature needs of the bodies which the controller determines; the pressure reduction valve includes a pressure reducing valve and a solenoid-operated proportional relief valve located between the controller and the pressure reducing valve and operatively connected to each to permit signals emitted from the controller to influence the pressure reducing valve to alter its outlet pressure to the fan hydraulic motor.

2. The system of claim 1 wherein an anti-cavitation hydraulic line is connected in parallel with the fan hydraulic motor and has opposite ends that are connected to inlet and outlet hydraulic lines entering and departing, respectively, the fan hydraulic motor; and a check valve in the anti-cavitation hydraulic line normally closing fluid flow in a direction from the inlet line to the outlet line, but which will open if the fan in a free-wheeling mode pumps fluid out of the fan motor and into the outlet line and the anti-cavitation hydraulic line, so that at least some of that fluid will move on through the check valve into the inlet line and thence back into the fan motor to prevent cavitation of the fan motor.

3. A hydraulic fan drive system, comprising, a fan coupled to a fan hydraulic motor and having the capability of operating at variable speeds up to a maximum speed, a single hydraulic pump connected to the fan hydraulic motor and having a pressure outlet flow capability greater than the fluid flow required to operate the fan motor at the maximum operating speed, a pressure reduction valve connected to a pressure flow outlet line of the pump upstream of the fan hydraulic motor, an electronic controller operatively connected to the pressure reduction valve to control the fluid pressure therethrough to the fan hydraulic motor, at least one functional hydraulic work circuit connected to the pressure outlet flow of the pump in addition to the fan hydraulic motor, a load sensor circuit connected to the pump, the work circuit, and to the pressure outlet of the pump at a location between the fan and pressure reduction valve so that if the work circuit requires more pressure than the fan hydraulic motor, the pump will produce such additional fluid pressure to the work circuit, and the pressure to the fan motor will be reduced; the pressure reduction valve includes a pressure reducing valve and a solenoid-operated proportional relief valve located between the controller and the pressure reducing valve and operatively connected to each to permit signals emitted from the controller to influence the pressure reducing valve to alter its outlet pressure to the fan hydraulic motor.

4. The system of claim 3 wherein an anti-cavitation hydraulic line is connected in parallel with the fan hydraulic motor and has opposite ends that are connected to inlet and outlet hydraulic lines entering and departing, respectively, the fan hydraulic motor; and a check valve in the anti-cavitation hydraulic line normally closing fluid flow in a direction from the inlet line to the outlet line, but which will open if the fan in a free-wheeling mode pumps fluid out of the fan motor and into the outlet line and the anti-cavitation hydraulic line, so that at least some of that fluid will move on through the check valve into the inlet line and thence back into the fan motor to prevent cavitation of the fan motor.

* * * * *